US011657987B2

(12) United States Patent
Kumar et al.

(10) Patent No.: US 11,657,987 B2
(45) Date of Patent: May 23, 2023

(54) DIELECTRIC SHIELD FOR A SWITCHING DEVICE

(71) Applicants: Lokesh Kumar, Aligarh (IN); Ratheesh Rajagopal, Thane (IN)

(72) Inventors: Lokesh Kumar, Aligarh (IN); Ratheesh Rajagopal, Thane (IN)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 17/230,088

(22) Filed: Apr. 14, 2021

(65) Prior Publication Data

US 2021/0319963 A1 Oct. 14, 2021

(51) Int. Cl.

| | |
|---|---|
| ***H01H 9/32*** | (2006.01) |
| ***H01H 31/00*** | (2006.01) |
| ***H01H 33/666*** | (2006.01) |

(52) U.S. Cl.

CPC ..... *H01H 9/32* (2013.01); *H01H 31/003* (2013.01); *H01H 33/666* (2013.01)

(58) Field of Classification Search

CPC ..... H01H 9/32; H01H 31/003; H01H 33/666; H01H 33/662; H01H 33/66261

USPC ..... 218/117, 119, 140, 139

See application file for complete search history.

(56) References Cited

U.S. PATENT DOCUMENTS 3,597,556 A * 8/1971 Sharp ..... H01H 3/46 218/4
3,697,819 A * 10/1972 Eichelberger ..... H02B 13/02 361/603
3,970,810 A * 7/1976 Carroll ..... H01H 33/666 313/231.01
4,550,234 A * 10/1985 Steinemer ..... H01H 33/666 218/4

(Continued)

FOREIGN PATENT DOCUMENTS

CN 103700539 * 4/2014 ..... H01H 33/66
EP 0115739 A1 8/1984

(Continued)

OTHER PUBLICATIONS

Translation of CN103700539 (Original document published Apr. 2, 2014) (Year: 2014).*

(Continued)

*Primary Examiner* — William A Bolton
(74) *Attorney, Agent, or Firm* — Lempia Summerfield Katz LLC

(57) ABSTRACT

A pole assembly of a switching device is provided. The pole assembly includes a first interrupter unit operably connected to a pole plate of the pole assembly via first post insulators. The first interrupter provides a path for current flow through the first interrupter in a closed state and interrupts the current flow in an open state. A second interrupter unit is operably connected to the first interrupter unit and to the pole plate via second post insulators. The second interrupter allows the current flow through the first interrupter unit in an open state (Continued)

and grounds the switching device in a closed state. The pole assembly includes a dielectric shield physically disposable between and operably connected to the first post insulators and the second post insulators for uniformly distributing an electric field generated during operation of the pole assembly.

6 Claims, 4 Drawing Sheets

(56) References Cited

U.S. PATENT DOCUMENTS 4,797,777 A * 1/1989 Beard ..... H01H 39/00 361/115
6,295,190 B1 * 9/2001 Rinaldi ..... G01R 31/3274 361/96
6,462,296 B1 10/2002 Boettcher et al.
7,724,489 B2 * 5/2010 Montich ..... H01H 31/003 361/115
2009/0045171 A1 2/2009 Montich

FOREIGN PATENT DOCUMENTS

EP 0342603 A2 11/1989
EP 1120804 A1 8/2001
EP 2474991 A1 7/2012

OTHER PUBLICATIONS

European Search Report for European Application No. 20198083.6-1202 dated Mar. 19, 2021.

* cited by examiner (PRIOR ART)

(PRIOR ART)

DIELECTRIC SHIELD FOR A SWITCHING DEVICE

PRIORITY

This application claims the benefit of Indian Patent Application No. IN 202031016049, filed on Apr. 14, 2020, which is hereby incorporated by reference in its entirety.

FIELD

The present disclosure relates to switching devices such as circuit breakers. More particularly, the present disclosure relates to enhancing dielectric performance of a circuit breaker without increasing clearances and/or physical dimensions of the circuit breaker.

BACKGROUND

Like Circuit breakers, grounding or earthing transformers are an important component of any power network. More particularly, grounding transformers are essential for renewable power generator plants, for example, in large multi-turbine wind farms where the substation transformer frequently provides a sole earthing source for distribution system. A grounding transformer placed on a wind turbine string provides a ground path in an event when the string becomes isolated from the system ground provided by the substation transformer. A ground fault on a collector cable causes the substation circuit breaker to open, and the wind turbine string becomes isolated from the system ground source. The wind turbines do not always detect this fault or the fact that the string is isolated and ungrounded. As a result, the generators continue to energize the collector cable, and the voltages between the un-faulted cables and the ground rise far above the normal voltage magnitude. This results in a staggering increase in operational costs.

FIG. 1A illustrates a wind power generation system 100, according to the state of the art. The wind power generation system 100 has a string of wind turbines WTG1-WTGX each of which are connected to a medium voltage circuit breaker 101 and a grounding transformer 102, via respective line transformers 103A-103X. This wind power generation system 100 is then connected to a step-up transformer 104 to step up the voltage suitable for power transmission over the transmission system 105. FIG. 1B illustrates a wind power generation system 100 including a switching device 106 having a combined functionality of circuit breaking and ground switching, according to the state of the art. FIG. 1B discloses a variation of the wind power generation system 100 shown in FIG. 1A. In this variation, the circuit breaker 101 and the grounding transformer 102 are integrated into a single switching device 106. The switching device 106 performs the switching and grounding through a combined medium voltage circuit breaker and a grounding vacuum switch thereby, eliminating the grounding transformer 102.

The switching device 106 is, for example, a three phase medium voltage switchgear having an operational rating of up to 38 kilo Volts and up to 40 kilo Amperes and includes at least one pole assembly, per phase, in an operable connection with a drive unit via a drive connection rod. Each pole assembly includes a first interrupter unit (e.g., a circuit breaker) providing a path for current flow therethrough in a closed state and interrupting the current flow in an open state, and a second interrupter unit operably connected to the first interrupter unit allowing the current flow through the first interrupter unit in an open state and grounding the switching device in a closed state (e.g., acting as a grounding switch). The pole assembly includes a pole plate supporting the two vacuum interrupters representing a circuit breaker and a grounding switch, respectively, via multiple post insulators.

During occurrence of a lightening impulse voltage in the switching device 106, an electric field is generated around the live parts such as the vacuum interrupters. This electric field contains voltages of various magnitudes (e.g., varying potential across the field). Typically, a conductor, when placed in a voltage field having voltages of varying potential therein, experiences high levels of dielectric stress that may result in failure of the switching device 106 especially when exposed to high switching voltages.

For performing expected functions, aforementioned switching device 106 is required to withstand an impulse voltage of about 210 kVp. Further, the switching device 106 is required to withstand the impulse voltage with minimal increase in air clearances (e.g., a clearance of up to 335 mm between the pole plate and terminals of the interrupter units may be retained). This is because an increase in the air clearances beyond predefined limit leads to an increase in the overall physical dimensions of the product, thereby making the product bulky and increasing material and manufacturing overheads.

SUMMARY AND DESCRIPTION

The scope of the present invention is defined solely by the appended claims and is not affected to any degree by the statements within this summary.

The present embodiments may obviate one or more of the drawbacks or limitations in the related art. For example, a switching device that may successfully withstand rated switching impulse voltage without increasing physical dimensions of the switching device is provided.

A pole assembly of the switching device disclosed herein achieves this by a dielectric shield physically disposable between and operably connected to the post insulators supporting the interrupter units. In one embodiment, the dielectric shield is positioned longitudinally parallel to the pole plate and proximal to the first interrupter unit and the second interrupter unit to allow a near equipotential field to be created in the pole assembly around the dielectric shield. As used herein, "dielectric shield" refers to an elongate member constructed of a material exhibiting dielectric properties. The dielectric shield is configured to have a conducting material and/or an insulating material. In one embodiment, the dielectric shield is made of a conducting metal such as Copper, Aluminum, etc. that is then encapsulated with an insulating material such as a plastic compound, epoxy, etc. A thickness of the encapsulating material is dependent on dielectric properties of the insulating material chosen, such that the impulse voltage is withstood. A thickness of the conducting material is defined based on manufacturing constraints such as to avoid sharp edges, physical cracks, and deformities from occurring that may result in overall dielectric strength of the dielectric shield being affected.

According to an embodiment, distal surfaces and/or ends of the dielectric shield have insulating material extruded therefrom (e.g., these surfaces have conducting material without any insulating encapsulation). In one embodiment, these extrusions are present on both sides of the dielectric shield. These sides of the dielectric shield include a first side that operably connects to the post insulators and a second side that operably connects to an enclosure of an interlink arrangement positioned in between and in connection with the first interrupter unit and the second interrupter unit. The shapes and surface areas of the extrusions on the first side are equivalent to outer perimeters of post insulators connected to the dielectric shield. The shapes and surface areas of the extrusions on the second side are configured so as to establish contact with the enclosure of the interlink arrangement. In one embodiment, lack of insulating material on these extrusions allows for metal to metal connection, thereby enabling uniform distribution of the electric field around the interrupter units. According to another embodiment, the distal surfaces include an orifice centrally punched therethrough to allow conductors passing through the post insulators to be operably connected to the terminals of the respective interrupter units.

The first interrupter unit and the second interrupter unit are operably connected via the interlink arrangement that sets a stroke of the second vacuum interrupter without affecting a stroke of the first vacuum interrupter unit. The drive connection rod is used to set a stroke of the first interrupter unit (e.g., the circuit breaker). The interlink arrangement sets a stroke of the second vacuum interrupter (e.g., the grounding switch). The dielectric shield is positioned in proximity of the interlink arrangement. In one embodiment, at least one physical dimension of the dielectric shield is defined based on one or more physical properties associated with the interlink arrangement. With the interlink arrangement being a live component of the pole assembly, the electric field generated around the interlink arrangement is of a very high potential. In one embodiment, the dielectric shield is positioned longitudinally parallel to the interlink arrangement such that a length of the dielectric shield is equal to or more than a distance between a lower terminal of the first interrupter unit (e.g., a terminal proximal to the interlink arrangement) and an upper terminal of the second interrupter unit (e.g., a terminal proximal to the interlink arrangement). According to this embodiment, a width of the dielectric shield is defined to be greater than or equal to a width of the interlink arrangement. As used herein, interlink arrangement includes but is not limited to any enclosure in which the interlink arrangement may be secured and assembled in the pole assembly. According to another embodiment, the dielectric shield includes an orifice allowing passage of the drive connection rod therethrough for operably connecting to the interlink arrangement. In one embodiment, inner edges of this orifice have insulating material deposited thereon to prevent non-uniform distribution of the electric field.

According to an embodiment, the dielectric shield is configured of a generally rounded profile, for example, having gradual profiles along edges and/or around orifices positioned therein. A generally gradual profile such as rounded, beveled, etc. precludes electric flashovers from happening, thereby improving dielectric strength.

The dielectric shield, when positioned in the pole assembly in the aforementioned manner, enables uniform distribution of an electric field across the pole assembly when the switching device is in operation. By physically positioning the dielectric shield in a zone having high variation of potential, the electric filed is distributed nearly evenly thereby, reducing electric stresses faced by components of the pole assembly. This, for example, leads to withstanding of high impulse voltages without increasing air clearances and physical dimensions of the switching device.

This summary is provided to introduce a selection of concepts in a simplified form that are further described below in the following description. The summary is not intended to identify features or essential features of the claimed subject matter. Further, the claimed subject matter is not limited to implementations that solve any or all disadvantages noted in any part of this disclosure.

DETAILED DESCRIPTION

Figure 1A:
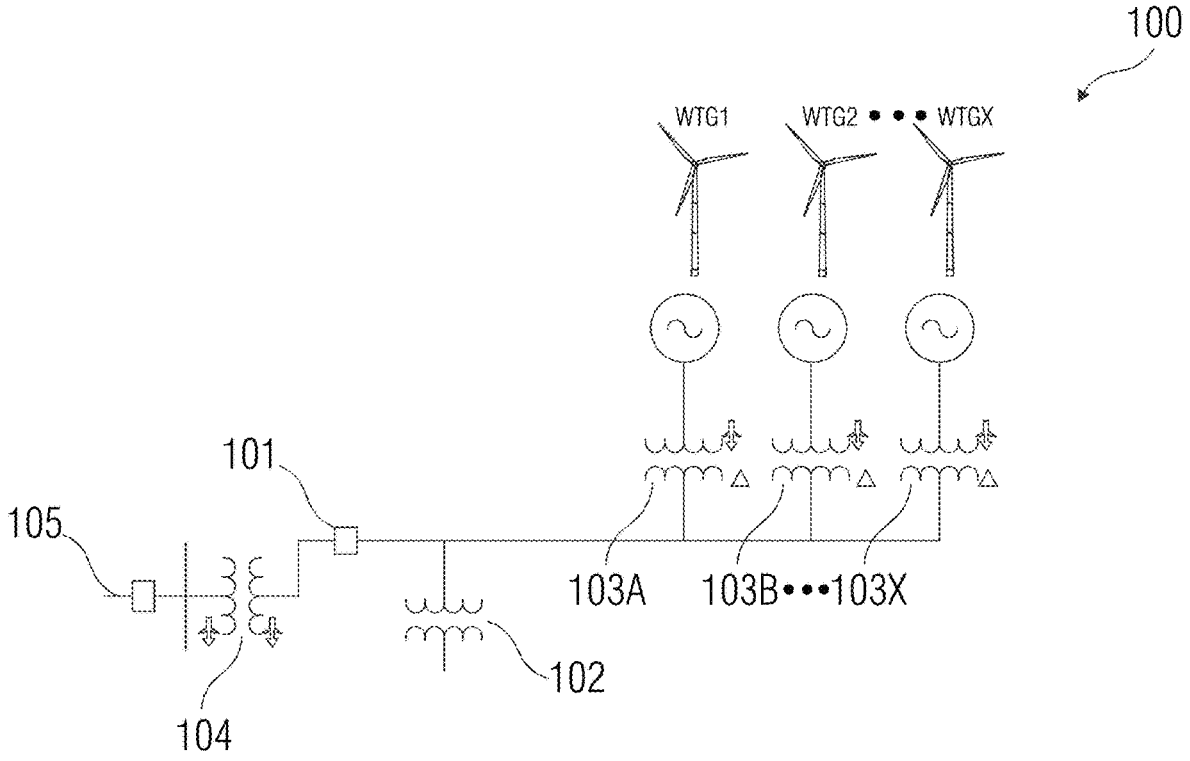
FIG. 1A illustrates a wind power generation system according to the state of the art.

Hereinafter, embodiments are described in detail. The various embodiments are described with reference to the drawings, where like reference numerals are used to refer to like elements throughout. In the following description, for purpose of explanation, numerous specific details are set forth in order to provide a thorough understanding of one or more embodiments. Such embodiments may be practiced without these specific details. In other instances, well known materials or methods have not been described in detail in order to avoid unnecessarily obscuring embodiments of the present disclosure. While the disclosure is susceptible to various modifications and alternative forms, specific embodiments thereof are shown by way of example in the drawings and will herein be described in detail. There is no intent to limit the disclosure to the particular forms disclosed; on the contrary, the disclosure is to cover all modifications, equivalents, and alternatives falling within the spirit and scope of the present disclosure.

Figure 1B:
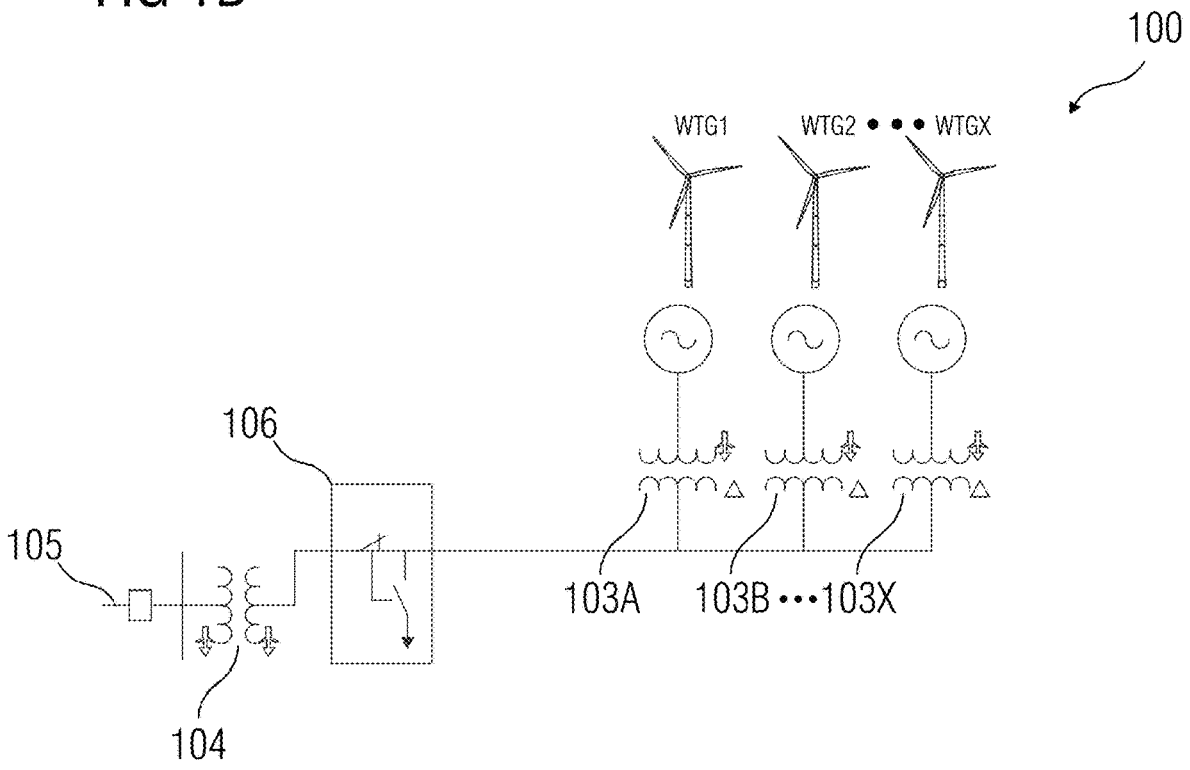
FIG. 1B illustrates a wind power generation system including a switching device having a combined functionality of circuit breaking and ground switching, according to the state of the art.
Figure 2:
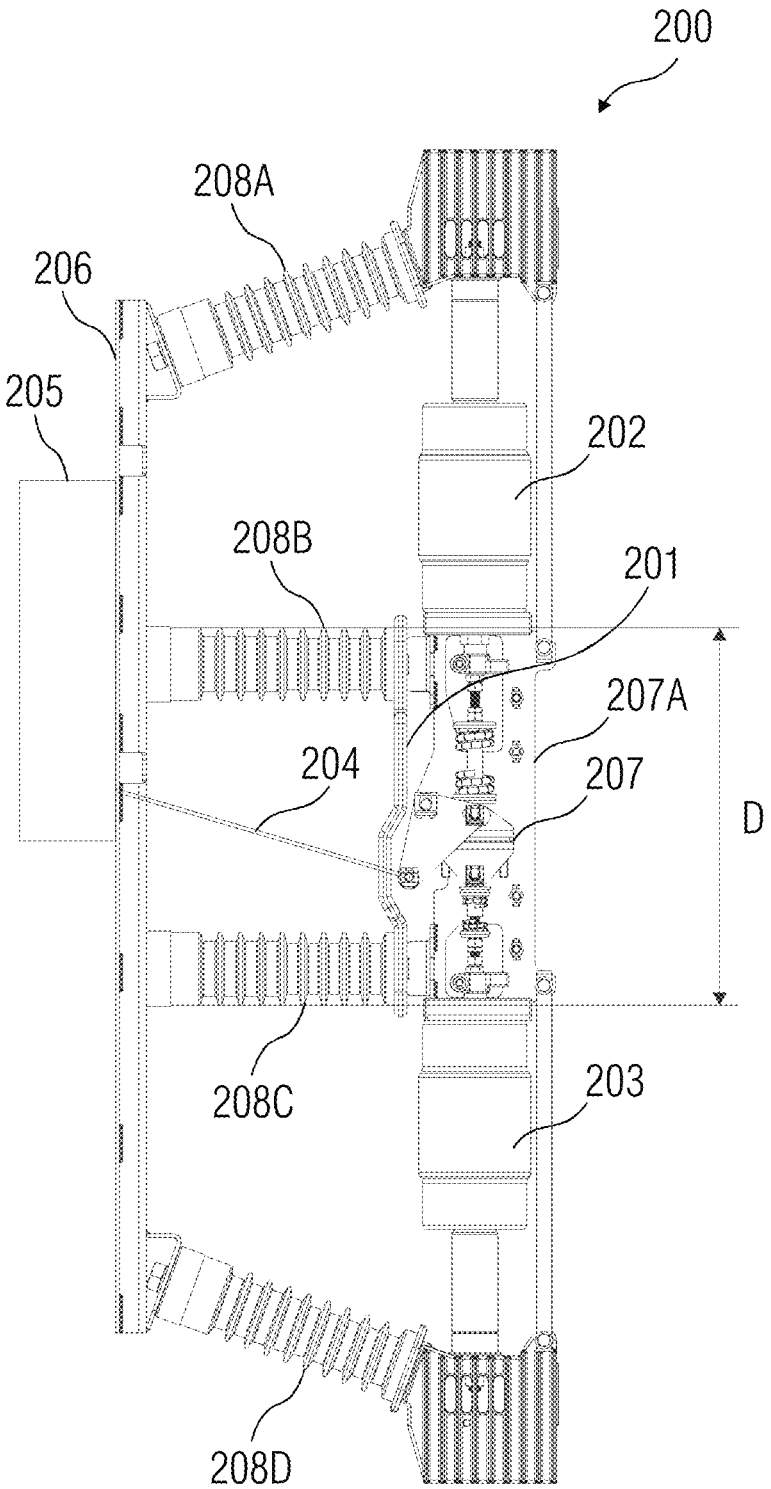
FIG. 2 illustrates a pole assembly for one phase of a switching device, according to an embodiment of the present disclosure.

FIG. 2 illustrates one embodiment of a pole assembly 200 for one phase of a switching device 106 shown in FIG. 1B, according to an embodiment of the present disclosure. The pole assembly 200 includes a vacuum interrupter 202 operably connected to another vacuum interrupter 203 via an interlink arrangement 207. The vacuum interrupter 202 represents the circuit breaker 101 shown in FIG. 1A, and the vacuum interrupter 203 represents the grounding switch 102 shown in FIG. 1A. The pole assembly 200 thus includes an integration of the circuit breaker and the grounding switch into a single switching device 106 shown in FIG. 1B. The interlink arrangement 207 is operably connected to a drive connection rod 204 that is connected to a drive unit 205 of a switching device 106. The interlink arrangement 207 allows for an adjustment of a stroke of the vacuum interrupter 203 (e.g., the grounding switch without affecting the stroke of the vacuum interrupter 202, the circuit breaker).

Post insulators 208A-208D of the pole assembly support the two vacuum interrupters 202 and 203. The vacuum interrupter 202 is supported by the post insulators 208A and 208B, and the vacuum interrupter 203 is supported by the post insulators 208C and 208D. The post insulators 208A-208D are rigidly attached to a pole plate 206 of the pole assembly 200. A dielectric shield 201 is positioned parallel to the pole plate 206 and in between the post insulators 208B and 208C, proximal to the interlink arrangement 207. Accordingly, a length of the dielectric shield 201 is nearly equal to a distance D between outer edges of the post insulators 208B and 208C, and a width of the dielectric shield 201 is nearly equal to a width of the interlink arrangement 207 (e.g., an enclosure 207A in which the interlink arrangement 207 is positioned). Thus, the dielectric shield 201 at least partially covers the interlink arrangement 207.

Figure 3:
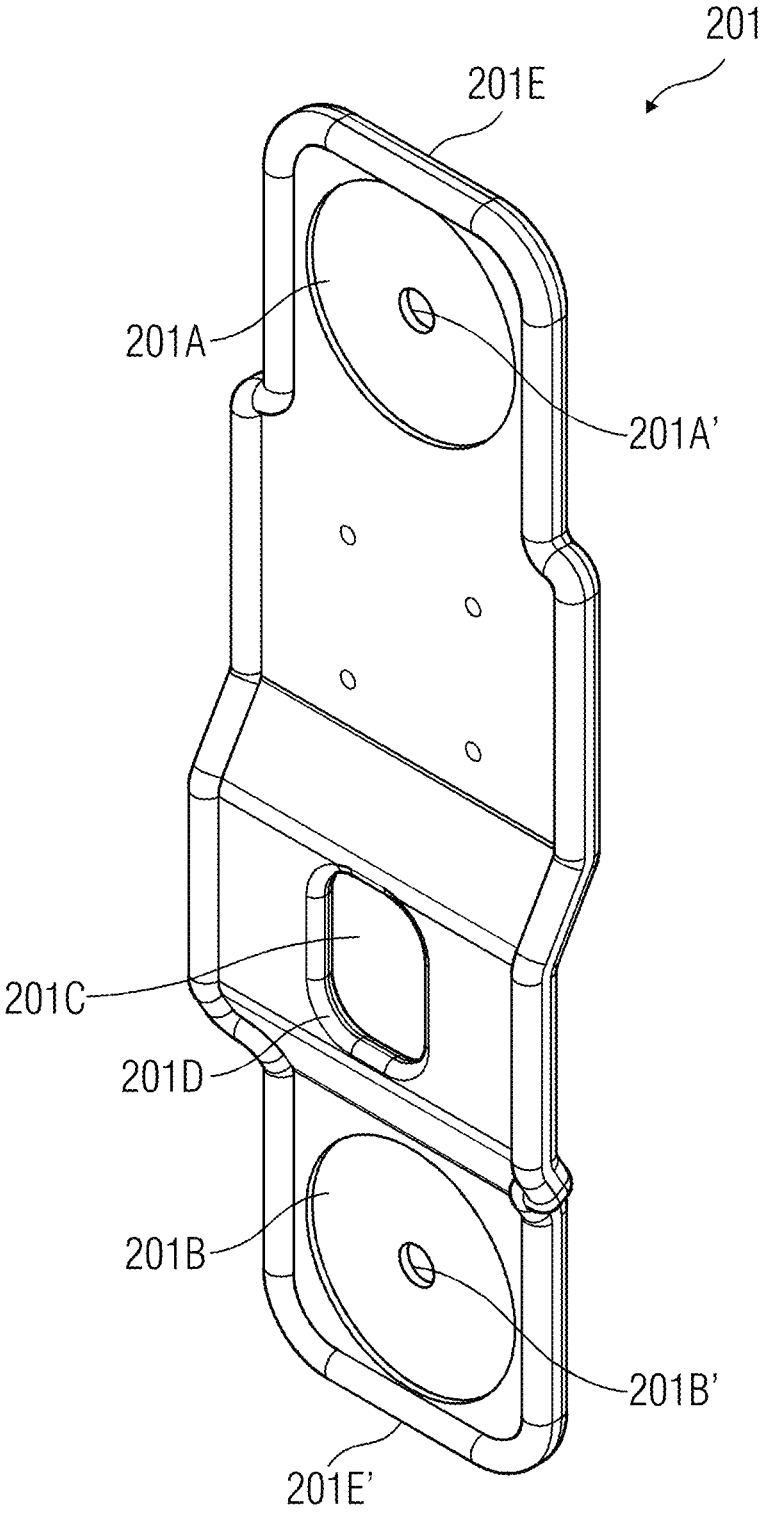
FIG. 3 illustrates a perspective view of a dielectric shield of the pole assembly shown in FIG. 2.

FIG. 3 illustrates a perspective view of a dielectric shield 201 of the pole assembly 200 shown in FIG. 2. The dielectric shield 201 is an elongate member rigidly connected at an end 201E to the post insulator 208B and at another other end 201E' to the post insulator 208C, shown in FIG. 2. The dielectric shield 201 is configured of an electrically conducting material encapsulated in an insulating material. The profile of the dielectric shield is configured such that connections of auxiliary components including but not limited to the drive connection rod 204, the interlink arrangement 207, the post insulators 208B, 208C, etc., of the pole assembly 200 are maintained with minimal changes in the assembly.

The dielectric shield 201 has extrusions 201A and 201B towards ends 201E and 201E', respectively. The extrusions 201A and 201B are shaped based on the shapes of the post insulators 208B and 208C so as to allow the post insulators 208B and 208C to be connected to the vacuum interrupters 202 and 203, respectively. The extrusions 201A and 201B have conducting material partially extruded from the dielectric shield 201 such that a thickness of the conducting material in areas defined by the extrusions 201A and 201B is lesser than an overall thickness of the conducting material elsewhere on the dielectric shield 201. The extrusions 201A and 201B are made of conducting material without any encapsulation of the insulating material. The dielectric shield 201 has orifices 201A' and 201B' centrally positioned within the extrusions 201A and 201B, respectively, to allow passage of conductors (not shown) within the post insulators 208B and 208C for connection to the vacuum interrupters 202 and 203, respectively. The dielectric shield 201 has another orifice (e.g., a cut-out 201C positioned thereon such that the drive connection rod 204 may pass therethrough for rigid connection with the interlink arrangement 207). Inner walls 201D of the cut-out 201C are coated with the insulating material.

The foregoing examples have been provided merely for the purpose of explanation and are in no way to be construed as limiting of the present invention disclosed herein. The embodiments described above are illustrative, not limiting. Further, although the invention has been described herein with reference to particular materials and embodiments, the invention is not intended to be limited to the particulars disclosed herein; rather, the invention extends to all functionally equivalent structures, methods, and uses, such as are within the scope of the appended claims. Those skilled in the art, having the benefit of the teachings of this specification, may effect numerous modifications thereto, and changes may be made without departing from the scope and spirit of aspects of the invention.

The elements and features recited in the appended claims may be combined in different ways to produce new claims that likewise fall within the scope of the present invention. Thus, whereas the dependent claims appended below depend from only a single independent or dependent claim, it is to be understood that these dependent claims may, alternatively, be made to depend in the alternative from any preceding or following claim, whether independent or dependent. Such new combinations are to be understood as forming a part of the present specification.

While the present invention has been described above by reference to various embodiments, it should be understood that many changes and modifications can be made to the described embodiments. It is therefore intended that the foregoing description be regarded as illustrative rather than limiting, and that it be understood that all equivalents and/or combinations of embodiments are intended to be included in this description.

The invention claimed is:

1. A pole assembly of a switching device, the pole assembly comprising:

a pole plate;

a first interrupter unit operably connected to the pole plate via a first post insulator and a second post insulator, the first interrupter unit operable to provide a path for current flow through the first interrupter unit in a closed state and interrupting the current flow in an open state; and a second interrupter unit operably connected to the first interrupter unit, the second interrupter unit operably connected to the pole plate via a third post insulator and a fourth post insulator, wherein the second interrupter unit is operable to allow the current flow through the first interrupter unit in an open state and operable to ground the switching device in a closed state; and a dielectric shield physically disposable between and operably connected to the third post insulator and the second post insulator, wherein the dielectric shield comprises an electrically conducting material encapsulated within an insulating material.

2. The pole assembly of claim 1, wherein the first interrupter unit and the second interrupter unit are operably connected via an interlink arrangement, and wherein the dielectric shield is positioned in proximity of the interlink arrangement.

3. The pole assembly of claim 2, wherein the dielectric shield is positioned longitudinally parallel to the interlink arrangement.

4. The pole assembly of claim 2, wherein the dielectric shield is positioned longitudinally parallel to the pole plate and proximal to the first interrupter unit and the second interrupter unit.

5. The pole assembly of claim 2, wherein at least one physical dimension of the dielectric shield is defined based on one or more physical properties associated with the interlink arrangement, wherein the at least one physical dimension comprises one or more of a length and a width of the dielectric shield, and wherein the one or more physical properties comprise one or more of a length and a width of the interlink arrangement.

6. The pole assembly of claim 1, wherein the dielectric shield has a generally rounded profile.

* * * * *